United States Patent [19]

Goldstein

[11] 4,272,851

[45] Jun. 16, 1981

[54] HAZARDOUS ENVIRONMENT SUIT

[75] Inventor: Lynn E. Goldstein, Cleburne, Tex.

[73] Assignee: Durafab Division of Texel Industries, Inc., Cleburne, Tex.

[21] Appl. No.: 12,655

[22] Filed: Feb. 16, 1979

[51] Int. Cl.[3] ..... A41D 13/02

[52] U.S. Cl. ..... 2/79; 2/82; 2/275

[58] Field of Search ..... 2/79, 2.1 A, 81, 82, 2/275; 428/104, 122, 193

[56] References Cited

U.S. PATENT DOCUMENTS

| | | | |
|---|---|---|---|
| 2,306,488 | 12/1942 | Morner | 2/82 UX |
| 3,113,320 | 12/1963 | Cherowbrier et al. | 2/81 |
| 3,525,334 | 8/1970 | Braman | 2/81 X |
| 4,190,010 | 2/1980 | Bibby | 2/275 X |

*Primary Examiner*—H. Hampton Hunter

*Attorney, Agent, or Firm*—Stoll and Stoll

[57] ABSTRACT

In a protective garment for insulating a worker from a hazardous environment, a suit manufactured from weldable or bondable material having a double overlapping zipper construction and welded or bonded seams having a binding stitched to the outside of the seams whereby the needle holes from such stitching do not extend to the interior of the garment.

4 Claims, 8 Drawing Figures

HAZARDOUS ENVIRONMENT SUIT

BACKGROUND OF THE INVENTION

Hazardous environment suits have been used to protect workers in contaminated areas. Basically, such suits are unitary enclosures with integral hoods and, as necessary, integral glove and boot portions. It is intended that such garments be used in contaminated environments and they are accordingly frequently intended to be "disposable", that is, being designed for single or limited use in view of the fact that the suits themselves may become contaminated by contact with the hazardous environment. The desirability of making such garments disposable has been enhanced by the use of lower cost materials when compared with materials which would otherwise be necessary to permit a suit to survive repeated cleaning and decontamination. At the same time, even reduced cost materials must be reasonably resistant to wear, tear, normal handling in use and, of course, resistant to the particular hazard or hazards of a given use. Thus, while garments may be made from material as inexpensive as paper, paper would not normally be resistant to moisture or chemical attack and would be subject to being easily torn, therefore rupturing the protective shield and destroying the garment's effectiveness.

A material which has come into use for hazardous area protective garments is a non-woven spunbonded olefin, an example of which is sold by e.i. duPont de Nemours & Company under its trademark Tyvek, which has coated or laminated on one side thereof a polyethylene film. Color may be added to the polyethylene film where laminated.

SUMMARY OF THE INVENTION

It is an object of the invention to provide a protective garment manufactured from a seam-bondable material with a seam construction which greatly increases the strength of the seam, greatly reduces the permeability of the seam and yet is economically feasible to manufacture.

It is a further object of the invention to provide a protective garment with a double overlapping zipper construction which increases the strength of the zipper opening area and reduces the permeability of that area to contamination.

Briefly, but not by way of limitation, the present invention provides a protective garment manufactured of a seam-bondable material such as olefin wherein the seams are ultrasonically welded and are provided with a sewn outside binding, the needle holes of which are on the exterior of the garment and are protected from piercing through to the interior of the garment by means of the ultrasonic weld. Further, a double overlapped zipper construction is provided in which a first zipper closes an opening in the material forming the main body of the garment while a second zipper overlaps the first zipper on the exterior thereof in a separate flap of material.

BRIEF DESCRIPTION OF THE DRAWING

FIG. 8 is a rear pictorial view of a modified embodiment of the hood portion of the protective garment of the present invention showing the air exhaust system.

DESCRIPTION OF THE PREFERRED EMBODIMENTS OF THE INVENTION

Figure 1:
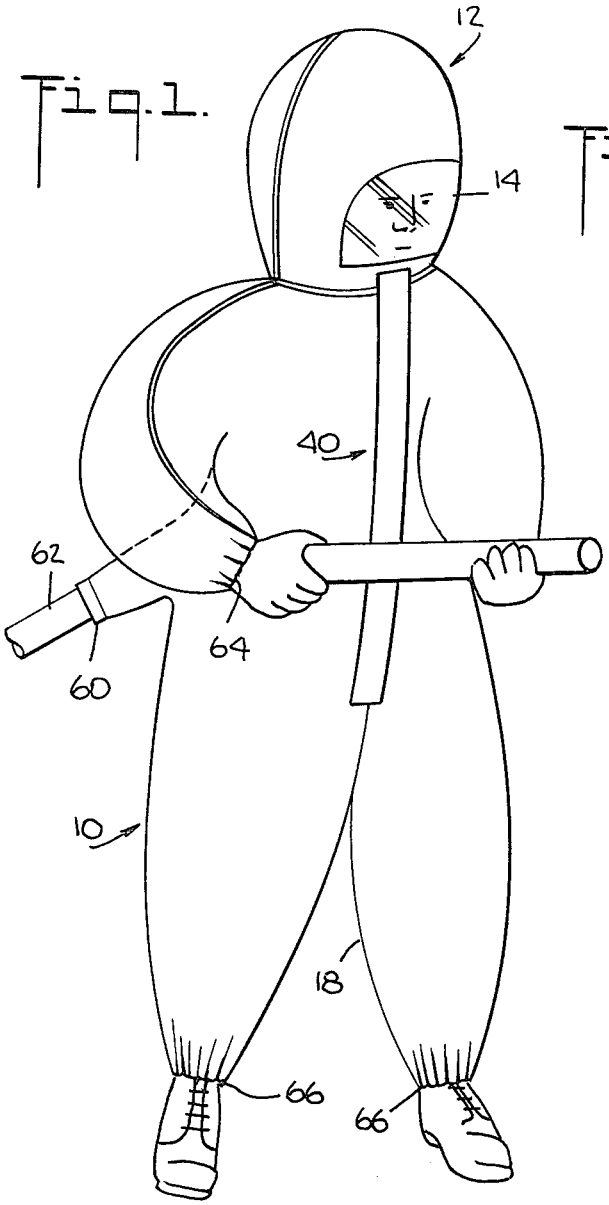
FIG. 1 is a pictorial view of the protective garment of the present invention shown in an illustrative use. The article held by the worker is not a part of the garment.
Figure 5:
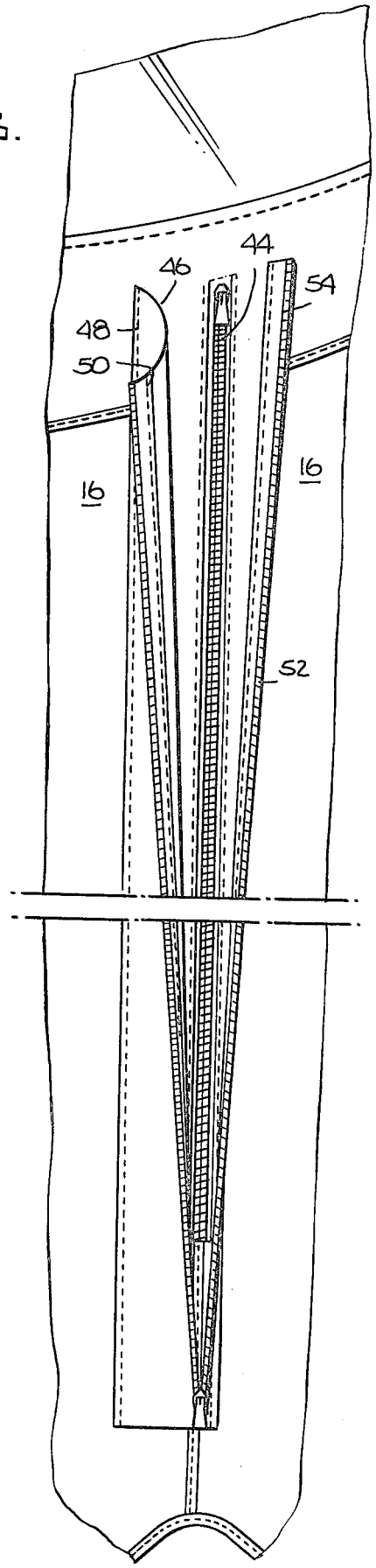
FIG. 5 is an enlarged fragmentary view of the dual-zipper opening of the protective garment of the present invention.

Referring to the drawing, protective garment 10 comprises a unitary overgarment having an integral hood 12 with a transparent front visor 14 sealed thereto. Protective garment 10 is manufactured of a seam-bondable material, a preferred example of which is olefin such as the non-woven spunbonded olefin Tyvek with polyethylene laminated to one side thereof as aforesaid.

Figure 6:
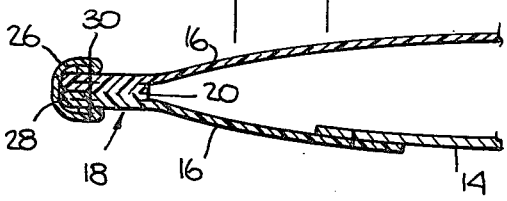
FIG. 6 is an enlared cross-sectional view taken across line 6—6 of FIG. 2 showing the seam construction of the present invention.
Figure 4:
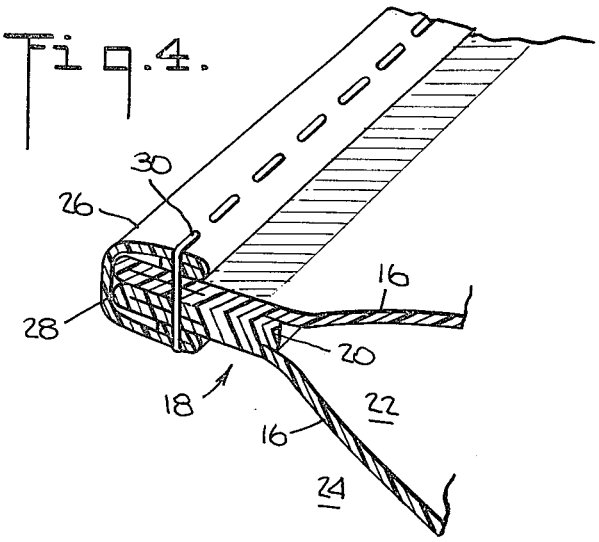
FIG. 4 is an enlarged cross-sectional view of a seam of the garment constructed in accordance with the invention as taken, for example, across line 4—4 of FIG. 2.
Figure 3:
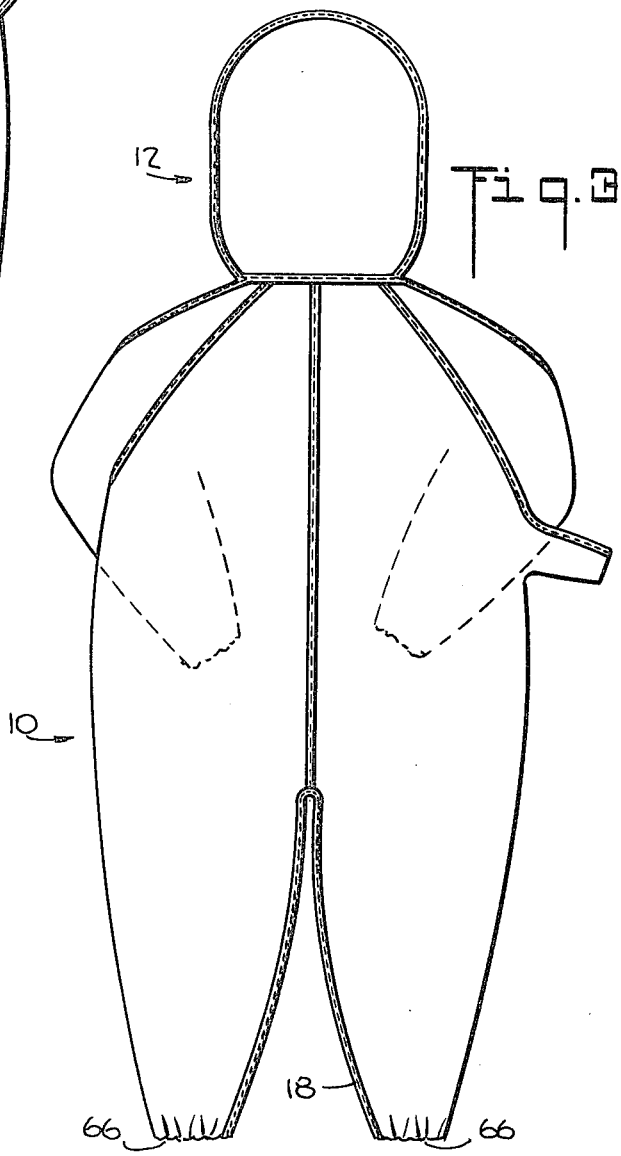
FIG. 3 is a rear view of the garment shown in FIG. 2.
Figure 5:
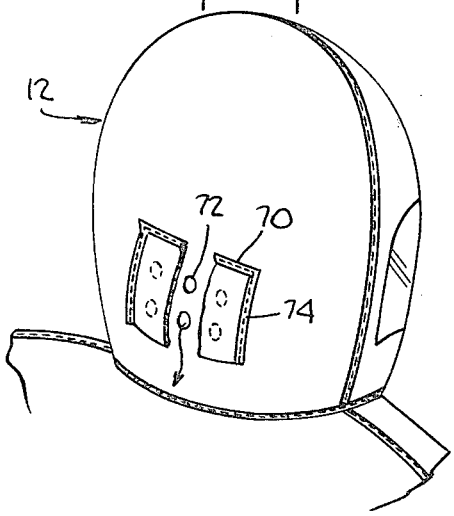

External seams of protective garment 10 are shown in FIGS. 4 and 6. Body material 16, preferably polyethylene coated (laminated) Tyvek, is joined together to form a seam 18 by welding or bonding material 16 together at the edges thereof. In the preferred embodiment, such welding is ultrasonically induced and in effect welds the two portions of material 16 into a common entity 20 which is air- and contaminent-impervious. Such ultrasonically welded portion 20 thoroughly seals the interior 22 of the garment from the hazardous external ambient conditions indicated generally by reference numeral 24.

Ultrasonically welded seam 18 not only provides the required sealing of the garment but also gives adequate strength against rupture from stress imposed across the seam. However, additional strength is desired against rupture from stress in shear along seam 18 and, accordingly, a binding 26 is wrapped around the external edge 28 of seam 18 and is secured thereto by means of stitching 30. It is a feature of the invention that such stitching, and the needle holes thereof, are on the outside of ultrasonically welded portion 20 whereby they do not penetrate to the interior 22 of garment 10. Thus, ultrasonically welded portion 20 of seam 18 continues to provide an unbroken barrier to the introduction of contaminants to within the garment.

In particular, stitching 30 and the needle holes thereof secure binding 26 to the outside edge 28 of seam 18 with the ultrasonically welded portion 20 being located between such stitching 30 and the interior 22 of garment 10. Not only does the relative location of the ultrasonically welded portion with respect to the needle holes improve the impermeability of the seam, but it also improves the strength of the seam as the welded portion is not disturbed by needle holes.

Access to garment 10 is provided by a zipper opening construction 40 located in the main body portion of garment 10 whereby the garment may easily be donned and removed.

Figure 7:
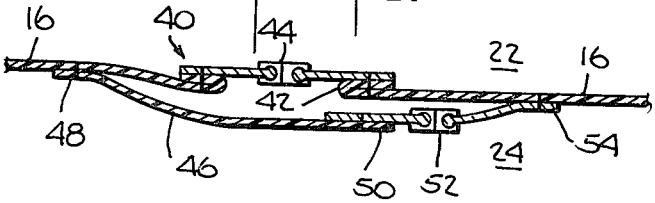
FIG. 7 is an enlarged cross-sectional view taken across line 7—7 of FIG. 2 showing the dual overlapping zipper construction of the present invention.
Figure 2:
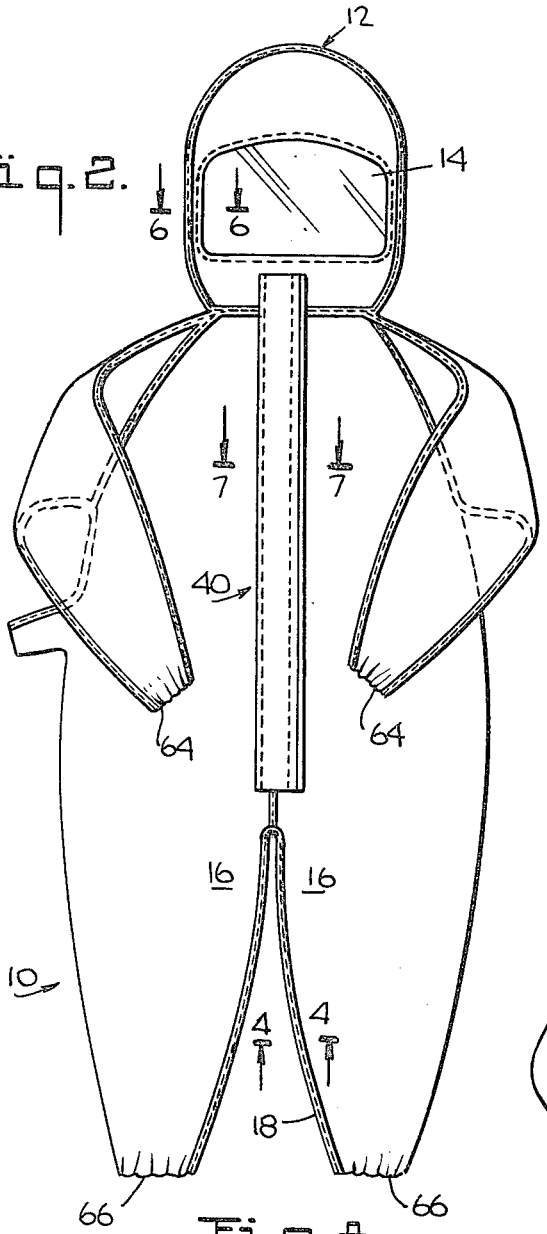
FIG. 2 is a front view of the protective garment of the present invention.

As may be seen in FIG. 7, material 16 of protective garment 10 is provided with a central opening 42 closeably secured by a conventional zipper 44 which is secured to body material 16 in a conventional manner. Extending over opening 42 and zipper 44 is an outer flap 46 secured by suitable means at one edge 48 to body material 16 and closed at its opposite edge 50 by means of a second zipper 52 which is itself secured to body material 16 along one side edge 54 thereof. Access to the interior of the garment may accordingly be had only by opening both zippers 44 and 52 and the combination of the two zippers, one over the other, results in a stronger, more contaminant-proof closure system.

Further reduction in the intake of contaminants into the interior of protective garment 10 is provided by pressurizing the interior of the garment to a pressure in excess of that of the hazardous surroundings. Pressurization is provided by means of an air intake port 60 connected by suitable conduit 62 to a source of clean filtered breathable air. Pressurization, accomplished by conventional means, prevents ambient contaminants from entering the garment as there is a continual outflow of air from such openings as wristlets 64, anklets 66, any leaking seams and the zipper area 40. By reason of pressurization, it is not necessary that each zipper 44 or 52 be sealed to the garment by ultrasonic means although that is not excluded if conditions so require.

In some instances in which protective garment 10 is securely sealed at all points, exhaust means for pressurized air is provided in a modified embodiment of the invention as shown in FIG. 8. Such exhaust means 70 comprise a plurality of exhaust ports 72 covered by an inverted pocket 74 which is sealed to hood portion 12 at the sides and top with the bottom thereof being open for exhaust of air. Cover 74 protects exhaust port 72 from entry of dirt and other substances.

While the foregoing is illustrative of a preferred and a modified embodiment of the invention, other embodiments may be had within the scope hereof.

What is claimed is:

1. A protective garment for use in contaminated areas, comprising:

a. laminated seam-bondable body material, said seam-bondable body material forming the body of said garment and comprising non-woven spunbonded olefin having laminated to one side thereof a polyethylene film, b. bonded seams, said bonded seams being formed of said seam-bondable body material and comprising an ultrasonically induced welded seam portion, c. binding means on the outside of said bonded seams, said binding means comprising a sewn binding sewn externally of said bonded seam, the stitching of said sewn binding being positioned such that said welded seam portion is located between said stitching and the interior of said garment, and d. double zipper means securing a body opening in said garment.

2. A protective garment in accordance with claim 1. wherein said double zipper means comprises first zipper means secured to said garment and having a central opening therein and second zipper means secured about said first zipper means, said second zipper means comprising a flap secured along one edge thereof to said body, extending over said central opening of said first zipper means and a zipper securing a second edge thereof to said body.

3. A protective garment in accordance with claim 2, wherein said garment additionally comprises air inlet means and air exhaust means, said air inlet means comprising an intake tube connected to a source of clean air and said air exhaust means comprising exhaust ports covered by a protective flap.

4. A protective garment in accordance with claim 3, wherein the interior of said garment is pressurized to a pressure in excess of the external ambient pressure.

* * * * *